US006918141B2

(12) United States Patent
Green et al.

(10) Patent No.: US 6,918,141 B2
(45) Date of Patent: Jul. 19, 2005

(54) PROTECTIVE HEADGEAR SYSTEM

(75) Inventors: Lawrence Green, Santa Ana, CA (US); Obed Rios, Santa Ana, CA (US); Celestino Murillo, Garden Grove, CA (US)

(73) Assignee: Pabbon Development, Inc., Irvine, CA (US)

( * ) Notice: Subject to any disclaimer, the term of this patent is extended or adjusted under 35 U.S.C. 154(b) by 0 days.

(21) Appl. No.: 10/667,417

(22) Filed: Sep. 23, 2003

(65) Prior Publication Data

US 2005/0060788 A1 Mar. 24, 2005

(51) Int. Cl.[7] ..... A42B 1/08

(52) U.S. Cl. ..... 2/424; 2/171.3; 128/201.23; 128/201.25; 128/205.29

(58) Field of Search ..... 2/424, 171.3, 410; 128/201.25, 201.22, 201.23, 201.24, 205.29, 201.29

(56) References Cited

U.S. PATENT DOCUMENTS

| | | | | | |
|---|---|---|---|---|---|
| 518,822 | A | * | 4/1894 | Moran | 128/201.23 |
| 2,597,764 | A | * | 5/1952 | Tucker et al. | 2/424 |
| 3,688,314 | A | * | 9/1972 | Hill | 2/457 |
| 4,280,491 | A | * | 7/1981 | Berg et al. | 128/201.24 |
| 4,730,612 | A | * | 3/1988 | Dampney | 128/201.24 |
| 4,852,562 | A | * | 8/1989 | Howie | 128/201.25 |
| 5,054,480 | A | * | 10/1991 | Bare et al. | 128/201.25 |
| 5,104,430 | A | * | 4/1992 | Her-Mou | 55/385.1 |
| 5,549,104 | A | * | 8/1996 | Crump et al. | 128/201.25 |
| 5,577,495 | A | * | 11/1996 | Murphy | 128/201.24 |
| 5,592,936 | A | * | 1/1997 | Thomas et al. | 128/206.12 |
| 5,765,235 | A | * | 6/1998 | Arnold | 2/424 |
| 5,887,281 | A | * | 3/1999 | Green et al. | 2/171.3 |
| 6,161,225 | A | * | 12/2000 | Arai | 2/424 |
| 6,622,311 | B2 | * | 9/2003 | Diaz et al. | 2/171.3 |
| 6,711,748 | B2 | * | 3/2004 | Paris et al. | 2/171.3 |
| 6,792,944 | B1 | * | 9/2004 | Green et al. | 128/201.22 |

FOREIGN PATENT DOCUMENTS

| | | | | | |
|---|---|---|---|---|---|
| GB | 2061696 | A | * | 5/1981 | A42B/3/00 |

* cited by examiner

*Primary Examiner*—Rodney M. Lindsey
(74) *Attorney, Agent, or Firm*—G. Donald Weber, Jr.

(57) ABSTRACT

This invention is directed to a protective headgear system which includes a relatively light weight, substantially rigid, headgear structure which may include an internal, adjustable headband. A fan mechanism is mounted on the headgear structure. A power supply selectively powers the fan. The system includes filter means which is attachable to the headgear structure to cover the structure. A facial shield is attachable to the headgear structure to cover the face of the wearer to maintain non-contaminating conditions relative to the wearer. A shield protector is attachable to the facial shield. A flexible cuff is attachable to the facial shield to enclose the lower opening of the lens and provide protection for the wearer.

20 Claims, 5 Drawing Sheets

PROTECTIVE HEADGEAR SYSTEM

BACKGROUND

1. Field of the Invention

This invention is directed to personal environmental protection systems, in general, and, more particularly, to a headgear structure which is worn by an individual in an environment wherein control of filtered air and protection from particulate material is required.

2. Prior Art

There are several types of air flow, filtration and protective systems which are known in the art. Several types of such systems are currently available on the market for use in surgical arenas, in "clean room" environments, or in hazardous/contaminated environments.

Some of the existing systems include hoods, gowns, filters, and the like. In some instances, the air filters are built into the helmet structure and produce a rather clumsy, cumbersome headgear unit. Known units frequently include external sources of air such as gas cylinders, air lines or the like which are connected to the helmet structure by tubes, hoses or the like. The hose-connected systems, and the long gowns or hoods tend to become extremely cumbersome as well as restrictive of the movements and flexibility of the wearer during a procedure.

In many of the systems known in the art the hoods and/or gowns are used as filtration devices which have to be replaced frequently. This structure tends, therefore, to become costly inasmuch as the disposable filtration devices are quite expensive.

Moreover, these systems tend to be fairly expensive, especially regarding the disposable portions of the system.

Many such products are known in the prior art. One suitable and functional system is described in U.S. Pat. No. 5,054,480; PERSONAL AIR FILTRATION AND CONTROL SYSTEM, R. O. Bare et al.

Another such system is described in U.S. Pat. No. 5,711,033; AIR FILTRATION AND CONTROL SYSTEM INCLUDING HEADGEAR by L. J. Green, et al.

SUMMARY OF THE INSTANT INVENTION

This invention is directed to a protective headgear system which is worn by a surgeon during a surgical procedure, a technician during an assembly process, a worker during handling of toxic wastes, or the like.

The system includes a relatively light weight, substantially rigid, headgear structure. Typically, a fan mechanism is mounted on the headgear structure. A suitable power supply, such as a battery pack or the like, can be used to selectively power the fan.

The system also includes a removable and disposable filter which is adapted to be easily and snugly attached to the headgear structure to significantly cover the outer surface of the headgear structure. An optional, separate pre-filter may also be provided for mounting over the disposable filter.

A transparent facial shield (or lens) is adapted to easily attach to the headgear structure so as to cover the face of the wearer in order to maintain sterile, non-contaminating conditions for the wearer. An optional lens cover can be attached to the facial shield to protect the shield from abrasion caused by cleaning.

A flexible, closable cuff is adapted to be easily attached to the lower edge of the facial shield in order to enclose the lower projection of the lens and provide a seal about the wearer's head.

An adjustable headband is attached to the headgear structure for supporting the assembled structure on the wearer's head.

DESCRIPTION OF A PREFERRED EMBODIMENT

Figure 5:
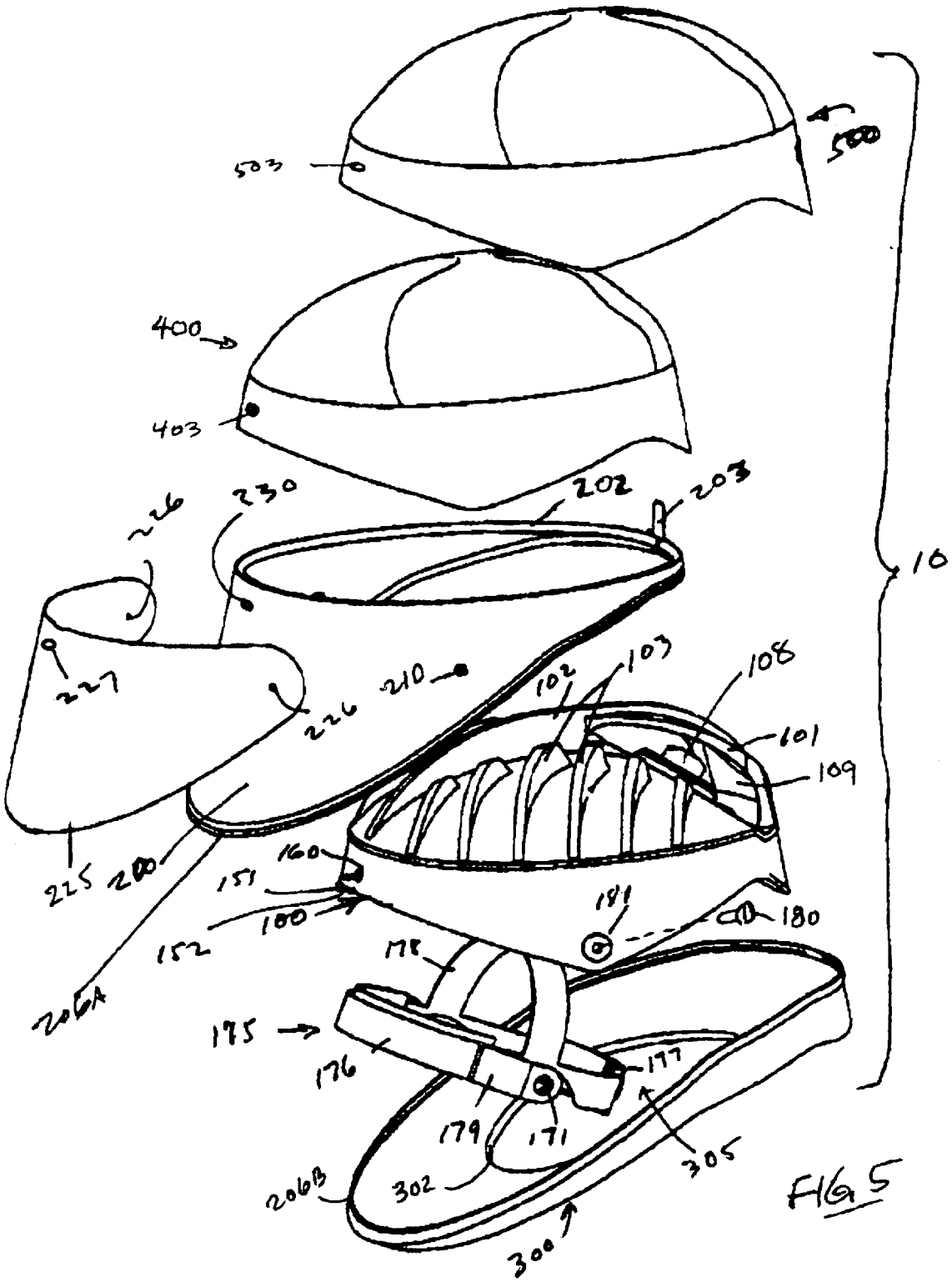
FIG. 5 is an exploded view of the embodiment of the headgear structure of the instant invention as shown in FIGS. 1, 2 and 3.

Referring to all of the Figures concurrently, there is shown one embodiment of the helmet assembly 10 of the instant invention. The helmet assembly 10 includes the helmet shell 100, the fan mechanism 108, the outer filter (or pre-filter) 500, the inner or main filter 400, the facial shield 200, the lens protector 225, the cuff 300, and the headband 175. An exploded view of the assembly 10 is shown in FIG. 5.

Figure 1:
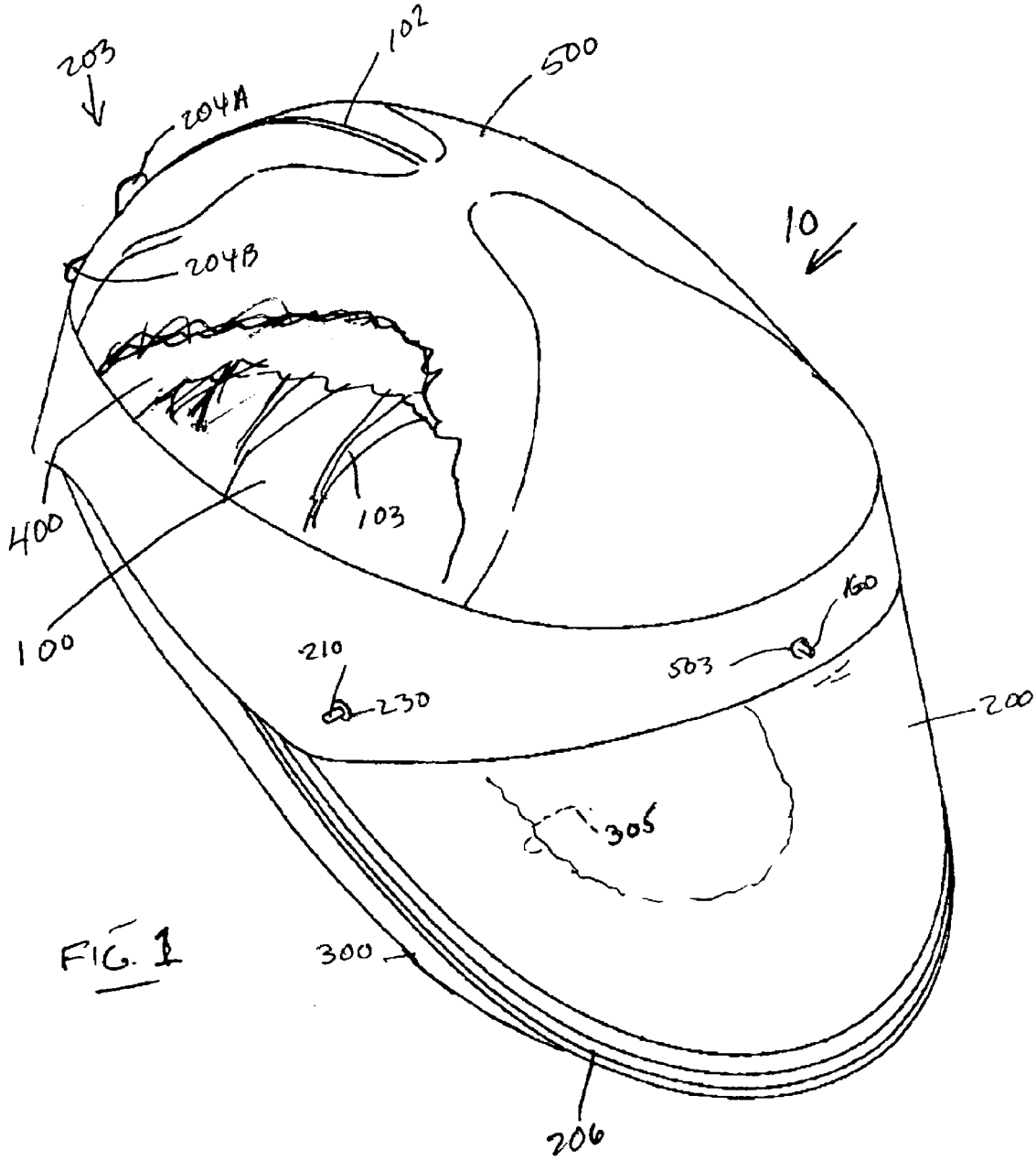
FIG. 1 is a front perspective view of one embodiment of the assembled helmet system of the instant invention.
Figure 2:
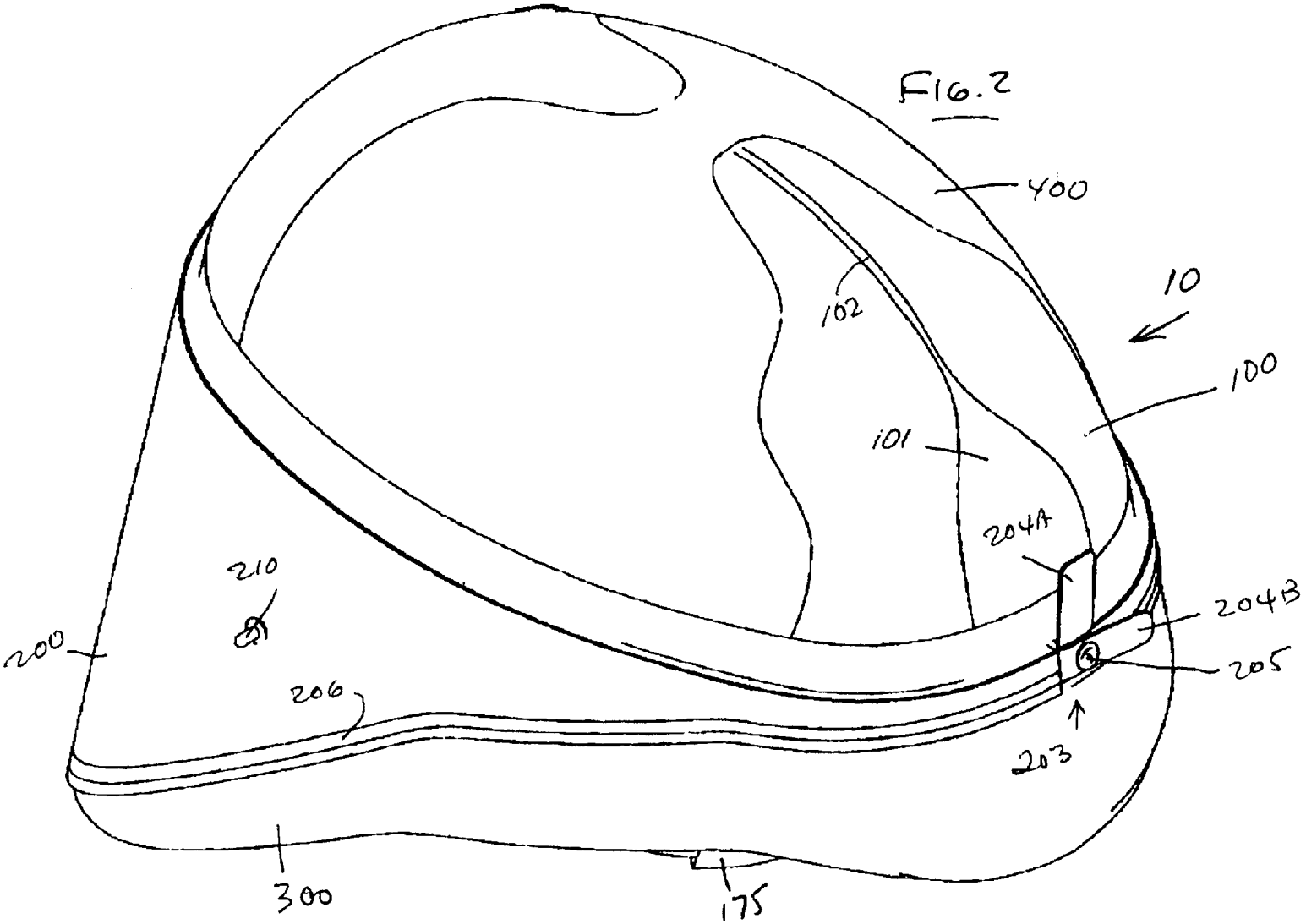
FIG. 2 is a back perspective view of one embodiment of the assembled helmet system of the instant invention.

The helmet shell 100 (see FIGS. 1 and 5) is, typically, formed of a lightweight material, such as PETG or Polycarbonate, for example. Helmet shell 100 is configured to conform, generally, to the shape of the upper portion of the wearer's head but to be spaced away from the top of the head of the wearer by the headband 175 described infra.

In addition, as will be described infra, the helmet shell 100 is sufficiently sturdy so as to support a cooling or air moving mechanism 108, typically, e.g. a fan or the like.

A plurality of radial fins 103 extend upwardly from the outer surface of the helmet shell 100 and radiate outwardly from the longitudinal center of the helmet shell 100 toward the perimeter thereof. A central fin 102 extends upwardly from the outer surface of the helmet shell 100 at the longitudinal center thereof. The radial fins 103 may be integral with the central fin 102 although this configuration is not required.

A fan covering 101 (see FIG. 5) extends above the outer surface of helmet shell 100. The fan covering 101 is joined to or is integrally formed with central fin 102 to provide a protective and contouring cover for the fan mechanism 108 of any conventional type as, for example, described in U.S. Pat. Nos. D 460,584 and 6,792,944. Thus, the fan covering 101 provides a spacer for maintaining a distance between the helmet shell 100 and filter 400. A fan opening 109 is provided through the side portion of the fan covering 101.

The fan covering 101 as well as the fins 102 and 103 serve to support the protective filter 400 above the helmet shell 100. Thus, air flow channels can be defined and maintained around the helmet assembly 10 whereby the fan mechanism 108 can provide a cooling and filtered air flow to the wearer of the helmet assembly 10. The exploded view of FIG. 5 permits a clearer illustration of the components of the helmet assembly.

A suitable socket 181 at each side of the helmet shell 100 and a suitable socket 171 at each side of the headband 175 is provided for receiving connectors 180, such as pan screws or the like, to secure headband 175 to the helmet shell as described infra.

A mounting pin 160 is attached to the front of the helmet shell 100. The mounting pin 160 is provided to receive and position facial shield (or lens) 200 as described infra.

Mounted at the front of the helmet shell 100 are light emitting diodes (LED) 151 and 152 or similar indicating devices. These diodes are disposed so that they are readily observable by the wearer of helmet assembly 10 without obscuring the view or otherwise distracting the wearer. The LEDs 151 and 152 are, preferably, of different colors such as red or yellow, respectively. One diode serves to selectively indicate a low battery condition while the other diode serves to selectively indicate a low airflow condition. The diodes 151 and 152 are connected to control circuits (such as described in U.S. Pat. No. 6,792,944 noted supra) by conductors (not shown) which are disposed on the inner surface of the helmet shell 100.

A filter 400 fabricated of electrostatically charged fibrous plastic material (melt blown polypropylene) is configured to conform to the outer shape of the helmet shell 100 and is adapted to fit fairly snugly thereto. By selecting the material of the filter 400, the level or degree of filtration of air which enters or leaves the helmet shell 100 can be controlled.

Figure 4:
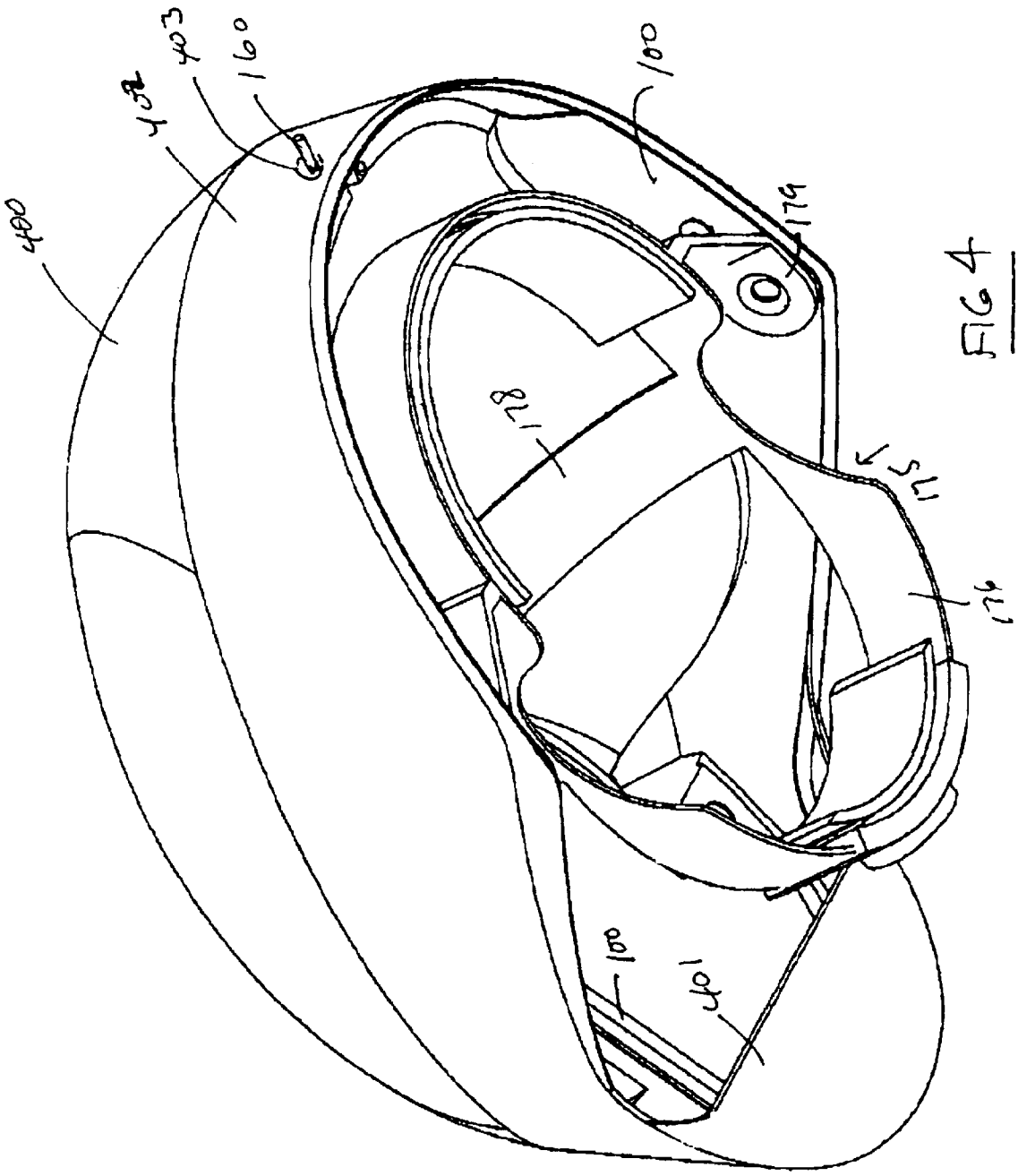
FIG. 4 is a lower front perspective view of a partially assembled helmet system which shows the main filter mounted on the helmet shell.

A pocket 401 in the back of the filter 400 (see FIG. 4) accepts the back end of the helmet shell 100. The front edge 402 of filter 400 is secured to helmet shell 100 with any suitable fastener such as velcro. In addition, the filter 400 includes an aperture 403 therethrough through which mounting pin 160 extends to position the filter 400. As will be described infra, the top edge of lens 200 clamps the perimeter of the main filter 400 to the helmet shell 100.

An optional pre-filter 500 (see FIGS. 1 and 5) can be provided, if desired. The pre-filter 500 can be fabricated of a material which is the same as filter 400, if so desired. Alternatively, to achieve a different filtration characteristic (or to reduce costs), the pre-filter 500 can be fabricated of a material such as felt or open cell foam which is different from the material of filter 400. Of course, prefilter 500 can be omitted altogether, if so desired.

The prefilter 500 attaches the helmet shell 100 the same way as the filter 400 with the exception that the prefilter 500 is placed over the top edge of the lens 200. For example, the aperture 503 engages the pin 160 and a pocket encases the back end of helmet shell 100.

A facial lens 200 fabricated of an impervious, transparent material such as polycarbonate is adapted to be mounted on the outer surface of helmet shell 100. The lens 200 includes a sealing gasket 202 mounted at the upper, substantially linear edge thereof. The gasket 202 is fabricated of a closed cell foam or other compressible material and is adapted to bear against the outer surface of the filter 400 which in turn bears on the outer surface of the helmet shell 100 thereby clamping the perimeter of the filter 400 in place. The juxtaposition of the inner surface of the filter 400 and the outer surface of the helmet shell 100 provides a secure, hermetic seal between the inner surface of the lens 200 and the outer surface of the helmet shell 100 as well as the inner surface of the filter 400 and the outer surface of the helmet shell 100.

Figure 3:
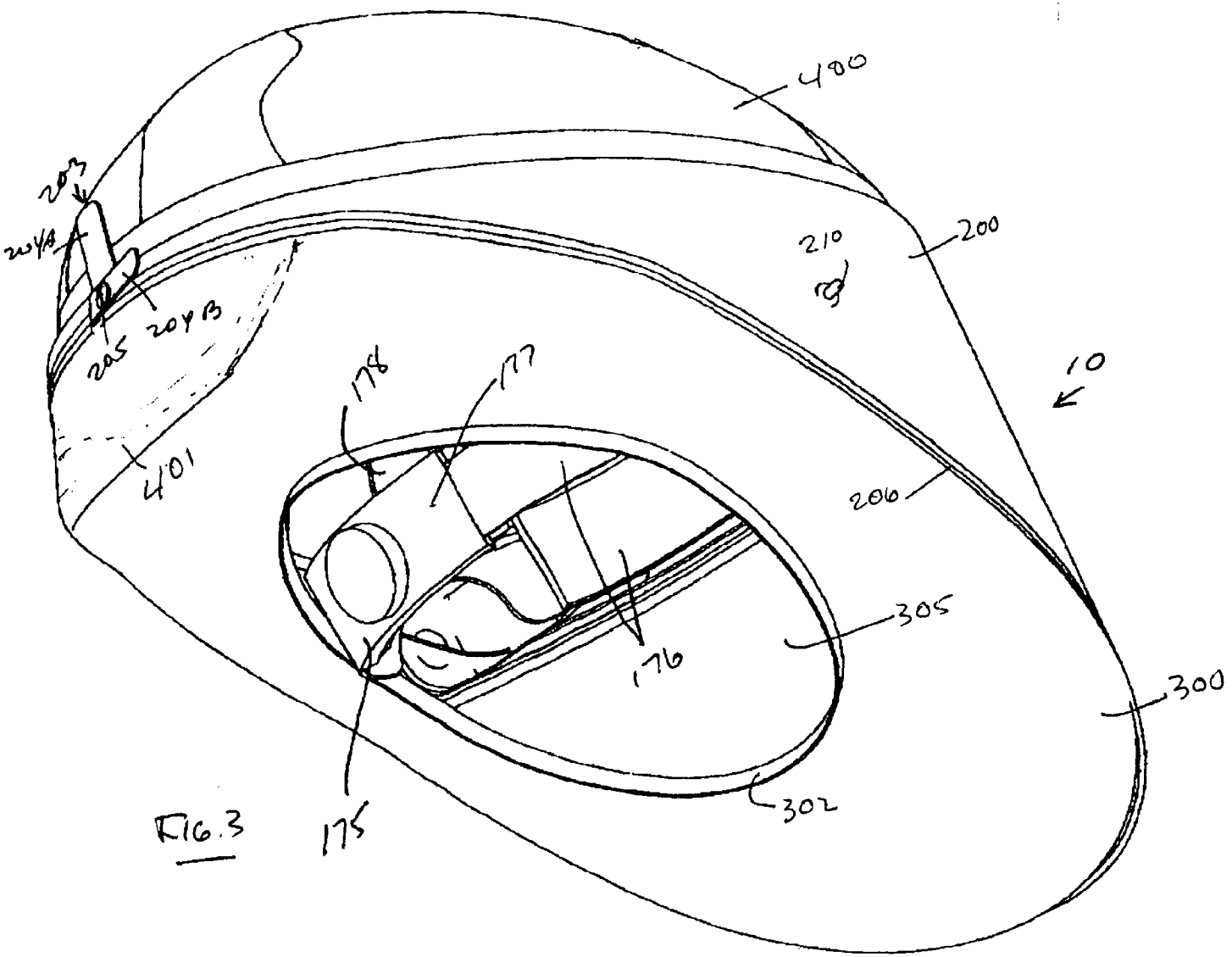
FIG. 3 is a lower rear perspective view of one embodiment of the assembled helmet system of the instant invention.

In one embodiment, the shield 200 (also referred to as lens 200) is fabricated of a single, plannar component which is adapted to bend and conform to the shape of the helmet shell 100. In this case, a suitable locking device 203 (see FIGS. 3 and 5) is provided to interconnect the ends of the lens 200 when the lens is assembled around the helmet shell 100. In one embodiment, the locking device 203 can comprise a pair of holding tabs 204A and 204B and a snap connector 205. Thus, the tabs 204A and 204B are held by the user to facilitate the engagement of the snap connection 204 when the shield is attached to the helmet shell 100. Other locking techniques are contemplated, as well.

A positioning aperture 230 is provided at the center of the shield 200 adjacent the upper edge thereof. The aperture 230 is placed over the mounting pin 160 on the helmet shell 100, as described supra, to position the shield 200 relative to the helmet shell 100.

In addition, one side of a zipper 206, viz. zipper side 206A, (see FIG. 5) is attached to the lower, curvilinear edge of lens 200 for attachment of the cuff 300, as described infra. The other side of zipper 206, viz. zipper side 206B, is attached to the outer edge of the cuff 300 described infra. The zipper side 206B is adapted to be selectively connected to the zipper side 206A in a conventional manner to thereby attach the cuff 300 to the lens 200 which is adapted to be attached to the helmet shell 100, as described supra.

The cuff 300 is fabricated of a sheet of flexible material such as rayon or plastic or meltblown polypropylene. This material, typically breathable, acts as a filter for ambient air adjacent to the wearer's head. The cuff also serves as a protective barrier to prevent particulate material from being transmitted to or from the wearer to or from the ambient.

The cuff 300 includes an opening 305 which is designed to be able to pass over the wearer's head. In a preferred embodiment, an elastic band 302 is attached to the circumference of opening 305. The elastic band 302 can be stretched to pass over the head of the wearer and then contract to form a reasonably snug by comfortable fit of the cuff 300 around the wearer's neck. Alternatively, a tie or drawstring or other securing means can be used to contract the head opening 305. The cuff 300, thus, provides a protective barrier for the wearer's head.

In an alternative embodiment, it is contemplated that filter 400, facial shield 200 and protective cuff 300 can be joined together and placed over the helmet shell 100 to provide the filtering and protecting functions described.

An optional lens protector 225 is, typically, fabricated of a thin film of polyester. The lens protector 225 is formed with a generally linear upper edge and a curvilinear lower edge. Mounting holes 226 are formed in the ends of the arcuate shaped protector and positioning hole 227 is formed in midportion of the protector 225 adjacent the upper edge thereof.

Positioning hole 227 is arranged to engage mounting pin 160 on the facial shield 200. The mounting holes 226 are arranged to interact with the mounting posts 210 which are attached to the outer surface of facial shield 200. Thus, protector 225 can be selectively attached to the helmet assembly for the purpose of preventing abrasions to the lens 200 which may be caused by wiping or cleaning. That is, the protector 225 can be placed in contact with the outer surface of shield 200 for protection thereof and then removed when appropriate and replaced, if necessary.

The headband 175 is used to seat the helmet 10 on the head of the wearer (not shown). The headband 175 is fairly conventional and is, also, optional. That is, a different head engaging support mechanism can be utilized or it can be omitted, if preferred.

The headband 175 includes the head-encircling band 176 (see FIGS. 3 and 5) which is adjustable to comfortably fit the head size of the individual wearer. The adjustment latch 177 permits the band 176 to be shortened or lengthened in a conventional manner.

An over-the-head strap 178 (see FIGS. 3 and 5) is attached to the band 176 in any conventional fashion. The band 176 and strap 178 may be integrally formed, if so desired. The strap and band are formed of a suitable material, such as nylon, for example. While adjustment of the length of band 178 is contemplated, this is not a required feature of the invention, per se.

The headband 176 includes suitable attachment arms 179 (see FIG. 5) which extend outwardly from the headband 176. The arms 179 are provided for attachment to the helmet 100 by means of suitable fasteners 180 which can be pan screws or the like, as discussed supra.

In operation, the components shown in the exploded view of FIG. 5 are assembled as described herein. The assembled headgear structure is then placed over the head of the wearer by passing the cuff 300 over the user's head. The headgear structure is put in place by adjusting the headband 175. The headgear structure is now ready for use by the wearer who receives filtered air through the filters. The filtered air is directed to the enclosed space created by the filters, helmet shield and cuff. This creates a clean air environment in proximity to the wearer's face.

Thus, there is shown and described a unique design and concept of a headgear system including an air filtration and control system. While this description is directed to a particular embodiment, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A protective headgear system comprising, a supportive shell, a facial shield adapted to be attached to said supportive shell by conforming said facial shield to the circumference of said supportive shell, a filtration device adapted to be mounted on top of said supportive shell and substantially secured thereto by said facial shield, and a protective covering adapted to be mounted to the lower portion of said facial shield.

2. The system recited in claim 1 including, a filter adapted for covering said filtration device.

3. The system recited in claim 1 including, a shield protector adapted to be mounted to said facial shield.

4. The system recited in claim 1 including, a headband adapted to be attached to the interior of said supportive shell.

5. The system recited in claim 1 wherein, said supportive shell includes at least one spacer device thereon for supporting said filtration device.

6. The system recited in claim 1 wherein, said facial shield includes a sealing means for removably sealing said facial shield and said filtration device to said supportive shell.

7. The system recited in claim 1 wherein, said protective covering comprises a layer of air permeable material.

8. The system recited in claim 1 wherein, said protective covering includes an aperture therein.

9. The system recited in claim 8 wherein, said protective covering includes an adjustable closure means for substantially closing said aperture.

10. The system recited in claim 9 wherein, said adjustable closure means comprises an elastic element around at least a portion of said aperture.

11. The system recited in claim 3 wherein, said shield protector is selectively removable from said facial shield.

12. The system recited in claim 1 wherein, said protective covering is mounted to said facial shield below said supportive shell.

13. The system recited in claim 1 including, zipper means for connecting said protective covering to a bottom edge of said facial shield.

14. The system recited in claim 3 wherein, said facial shield and said shield protector are substantially transparent to light.

15. The system recited in claim 1 wherein, said protective covering is fabricated of a flexible breathable material which substantially prevents transmission of particulate material therethrough.

16. A protective headgear system comprising, a supportive shell, a facial shield adapted to be attached to said supportive shell, said facial shield includes a sealing means for removably sealing said facial shield to said supportive shell, a filtration device adapted to be mounted on top of said supportive shell, said filtration device is secured to said supportive shell by said facial shield, a protective covering adapted to be mounted to said facial shield, a filter adapted for covering said filtration device, and a shield protector adapted to be mounted to said facial shield.

17. The system recited in claim 16 wherein, said protective covering conforms to the shape of said facial shield.

18. The system recited in claim 16 wherein, said filter conforms to the shape of said filtration device.

19. The system recited in claim 16 including, a support means on said supportive shell to space said filtration device away from said supportive shell.

20. The system recited in claim 16 including, fan means mounted to said supportive shell below said filtration device.

* * * * *